US011653749B2

(12) United States Patent
Liz Mola

(10) Patent No.: US 11,653,749 B2
(45) Date of Patent: May 23, 2023

(54) ERGONOMIC HANDLE PAINT BRUSHES

(71) Applicant: Jose Anibal Liz Mola, Freeport, NY (US)

(72) Inventor: Jose Anibal Liz Mola, Freeport, NY (US)

(73) Assignee: Jose Anibal Liz Mola, Freeport, NY (US)

( * ) Notice: Subject to any disclaimer, the term of this patent is extended or adjusted under 35 U.S.C. 154(b) by 219 days.

(21) Appl. No.: 17/071,488

(22) Filed: Oct. 15, 2020

(65) Prior Publication Data

US 2021/0112960 A1 Apr. 22, 2021

Related U.S. Application Data

(60) Provisional application No. 62/973,619, filed on Oct. 16, 2019.

(51) Int. Cl.
*A46B 5/02* (2006.01)

(52) U.S. Cl.
CPC ..... *A46B 5/021* (2013.01); *A46B 2200/202* (2013.01)

(58) Field of Classification Search
CPC ..... A46B 5/02; A46B 5/021; A46B 2200/202
See application file for complete search history.

(56) References Cited

U.S. PATENT DOCUMENTS

| | | | | | |
|---|---|---|---|---|---|
| 4,109,339 | A * | 8/1978 | Dietrich | A46B 5/02 | 16/DIG. 12 |
| 4,809,388 | A * | 3/1989 | Dietrich | A46B 5/02 | 15/160 |
| D337,201 | S * | 7/1993 | Haddad | D4/125 | |
| 5,517,713 | A * | 5/1996 | Hadcock | A46B 5/02 | D4/138 |
| D371,001 | S * | 6/1996 | Meeks | D4/125 | |
| 5,881,421 | A * | 3/1999 | Ducharme | A46B 9/04 | 15/159.1 |
| 6,742,213 | B1 * | 6/2004 | Vaes | A46B 3/12 | 15/159.1 |
| 9,878,436 | B1 * | 1/2018 | Castro | B25G 1/04 | |
| 2004/0231083 | A1 * | 11/2004 | Zaksenberg | A46B 5/02 | 15/160 |
| 2005/0201811 | A1 * | 9/2005 | Russell | A45D 34/042 | 401/6 |
| 2011/0099765 | A1 * | 5/2011 | Youssefieh | B25G 1/102 | 15/147.1 |
| 2015/0250298 | A1 * | 9/2015 | Griffiths | A46B 17/04 | 15/207.2 |
| 2016/0271785 | A1 * | 9/2016 | Hayes | A46B 17/02 | |
| 2019/0200741 | A1 * | 7/2019 | Kaye | A46B 5/021 | |
| 2019/0290412 | A1 * | 9/2019 | Thornton | A61C 15/02 | |
| 2020/0187744 | A1 * | 6/2020 | Diedrichs | A46B 5/0041 | |

* cited by examiner

*Primary Examiner* — Randall E Chin
(74) *Attorney, Agent, or Firm* — Hogan Lovells US LLP

(57) ABSTRACT

Disclosed herein is a paintbrush with an ergonomic handle to provide increased comfort to the user, in addition to preventing or relieving pain, preventing or relieving repetitive stain injury, or carpal tunnel syndrome, and/or providing greater efficiency in painting over longer periods of time.

18 Claims, 5 Drawing Sheets

ERGONOMIC HANDLE PAINT BRUSHES

RELATED APPLICATIONS

This application claims priority to U.S. Provisional Application No. 62/973,619, filed on Oct. 16, 2019, which is incorporated herein by reference in its entirety.

BACKGROUND

Conventional paintbrushes often feature an elongated handle that is straight. Typically, the handle of a conventional paintbrush places pressure on the user's hand (e.g., the thumb of the user), which can cause significant discomfort. Consequently, conventional paintbrushes can be difficult to hold for long periods and prolonged use can lead to repetitive strain injury along with other injuries, such a carpal tunnel syndrome. As such, there is a need in the art for paintbrushes with improved handles for increased comfort and prevention of repetitive strain injury.

SUMMARY

The present disclosure relates to a paintbrush with an ergonomic handle to increase comfort for the user.

Provided herein is an ergonomic paintbrush comprising: a handle comprising a neck segment, a top segment, a middle segment, and a bottom segment; and a brush head connected to the neck segment of the handle; wherein: (i) the top segment of the handle is aligned with the neck segment and brush head; (ii) the middle segment is laterally offset from the top segment by a first curve; and (iii) the bottom segment is laterally offset from the middle segment by a second curve; wherein the combination of the first curve and second curve forms a sigmoidal curve in the handle configured to fit between a user's thumb and fingers.

The second curve may be oriented in the opposite direction or the same direction relative to the first curve. For example, the middle segment can be laterally offset from the top segment in a left direction or a right direction, and the bottom segment can independently be offset from the middle segment in a left direction or a right direction. In some embodiments, the handle and brush head are substantially coplanar. A cross section of the handle, e.g., at the midpoint of the top segment, can be substantially rectangular.

In some embodiments, the handle is tapered (e.g., tapered from the neck segment to the top segment). In some embodiments, the handle is wider at the midpoint of the top segment relative to the midpoint of the middle segment. The width at the midpoint of the top segment may be from about 1 inch to about 3 inches. In some embodiments, the handle is wider at the midpoint of the middle segment relative to the midpoint of the bottom segment. The width of the handle at the midpoint of the middle segment may be from about 0.5 inches to about 1.5 inches.

In some embodiments, the top segment is about 1.5 inches to about 14 inches in length, the middle segment is about 1.5 inches to about 2.5 inches in length, and/or the bottom segment is about 2.5 inches to about 4.5 inches in length. In some embodiments, the top segment is about 2 inches to about 3.5 inches; about 2 inches to about 7.5 inches; or about 2 inches to about 13.5 inches long.

The brush head can comprise bristles that protrude from the opposite end of the brush head relative to the neck segment. In some embodiments, brush head further comprises a ferrule. In some embodiments, the bristles are substantially coplanar with the brush head and neck segment. In some embodiments, the bristles are of unequal length, e.g., to provide an angled toe. The bristles may comprise natural or synthetic fibers (e.g., nylon, polyester, or a combination thereof).

In some embodiments, the bottom segment further comprises a through hole. In some embodiments, the handle comprises wood, plastic, metal, or a combination thereof.

The paintbrush can be configured to be held by a user at about the middle and bottom segments of the handle. Further, the handle can be configured to reduce fatigue when using the paintbrush; reduce or prevent pain associated with repetitive strain injury (e.g., carpal tunnel syndrome) when using the paintbrush; or improve efficiency of painting when using the paintbrush.

In another aspect, the present disclosure relates to a paintbrush (e.g., an ergonomic paintbrush), comprising a brush head; and a handle connected to the brush head, the handle including a linear portion proximate to the brush head and a sigmoidal portion (e.g., distal to the brush head) including a first curve and a second curve shaped to fit between a thumb and a finger of a person when holding the handle.

DETAILED DESCRIPTION

Figure 1:
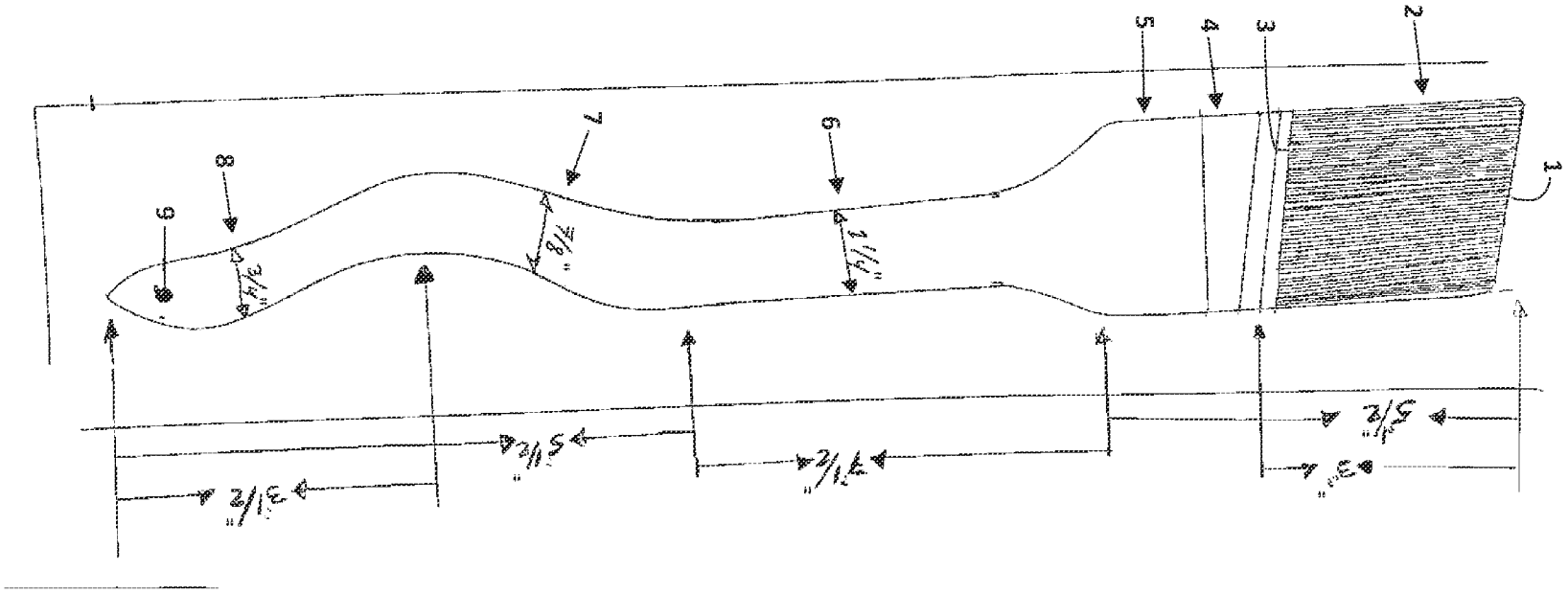
FIG. 1 provides a front perspective view of an exemplary ergonomic paintbrush, and provides reference numerals referenced herein.

Conventional paintbrushes place pressure on the user's hand (e.g., the thumb of the user), which can cause significant discomfort. After prolonged use, conventional paintbrushes can become difficult to hold and can lead to repetitive strain injury along with other injuries, such a carpal tunnel syndrome.

The present disclosure relates to paintbrushes with an ergonomic handle. The paintbrushes (e.g., ergonomic paintbrushes) described herein may provide increased comfort to the user, prevent or relieve pain in the hand, prevent or relieve repetitive strain injury, prevent or relieve carpal tunnel syndrome, or provide improved balance, as compared to a conventional paintbrush. Additionally, the paintbrushes of the present disclosure can provide better efficiency in painting over longer periods of time, relative to conventional paintbrushes.

As used herein, the terms "a," "an," and "the" include plural forms unless the context clearly indicates otherwise. The terms "include," "such as," and the like are intended to convey inclusion without limitation, unless otherwise specifically indicated.

Unless otherwise indicated, the terms "at least," "less than," and "about," or similar terms that precede a series of elements or a range should be understood to refer to every element in the series or range. Those skilled in the art will recognize, or be able to ascertain using no more than routine experimentation, many equivalents to the specific embodiments of the invention described herein.

As used herein, the term "about" or "approximately" can mean within an acceptable error range for the particular value, as determined by one of ordinary skill in the art, which will depend in part on how the value is measured or determined, e.g., the limitations of the measurement system being used. For example, "about" can mean a range of up to ±20%, up to ±15%, up to ±10%, up to ±5%, or up to ±1%, of a given value.

As used herein, the term "substantially" refers to the complete or nearly complete extent or degree of an action, characteristic, property, state, structure, item, or result. For example, an object that is "substantially" the same width as another object would mean that the object was either completely or nearly completely the same width as the other object.

As used herein, the terms "prevent," "preventing," or "prevention," of a disorder refer to causing the disorder (e.g., repetitive strain injury, e.g., carpal tunnel syndrome) or clinical symptoms of the disorder (e.g., pain) to not develop in a subject that can be exposed to or predisposed to the disorder, but does not yet experience or display symptoms of the disorder.

As used herein, the terms "relieve" or "alleviate" refer to reducing at least one symptom of a disorder (e.g., pain associated with repetitive strain injury), preventing additional symptoms, inhibiting the disorder, arresting the development of the disorder, causing regression of the disorder, relieving a condition caused by the disorder, or stopping the symptoms of the disorder.

In order to more clearly describe the paintbrush (e.g., ergonomic paintbrush) of the present disclosure, reference is made to FIG. 1 which is labeled according to reference numerals herein that refer to particular elements of the paintbrush.

The ergonomic paintbrush of the present disclosure may comprise a handle connected to a brush head 4. In some embodiments, the handle comprises one or more segments, e.g., a neck segment 5, a top segment 6, a middle segment 7, a bottom segment 8, or a combination thereof. In some embodiments, the handle comprises each of a neck segment, a top segment, a middle segment, and a bottom segment. The brush head may be connected to the handle by attachment to the neck segment. In some embodiments, the handle is a solid handle, comprising a neck segment, a top segment, a middle segment, and bottom segment. Preferably, the handle comprises a neck segment 5, a top segment 6, a middle segment 7, a bottom segment 8.

The handle may be designed such that not all segments are aligned along the same axis (e.g., are not coaxial). For example, instead of each segment being aligned along a single axis (e.g., as in a conventional paintbrush), one or more of the segments may be laterally offset relative to another segment or segments.

In some embodiments, the top segment 6 of the handle is aligned with the neck segment 5 and brush head 4; the middle segment 7 is laterally offset from the top segment by a first curve; and the bottom segment 8 is laterally offset from the middle segment by a second curve; wherein the combination of the first curve and second curve forms a sigmoidal curve in the handle, e.g., configured to fit between a user's thumb and fingers. The second curve may be oriented in the opposite direction or the same direction relative to the first curve. For example, the middle segment can be laterally offset from the top segment in a left direction or a right direction, and the bottom segment can independently be offset from the middle segment in a left direction or a right direction.

In some embodiments, the neck segment 5 and top segment 6 are aligned along a first axis, and the middle segment 7 is laterally offset from the first axis by curving to the right or left, defining a second axis. In some embodiments, the bottom segment 8 is laterally offset from the second axis by curving to the right or left, defining a third axis. In an embodiment, the middle segment 7 is laterally offset from the first axis by curving to the right, and the bottom segment 8 is laterally offset from the second axis by curving to the left. In an embodiment, the middle segment 7 is laterally offset from the first axis by curving to the left, and the bottom segment 8 is laterally offset from the second axis by curving to the right.

In some embodiments, the first curve is laterally offset from the first axis in a right direction or a left direction, and the second curve is laterally offset from the second axis in the opposite direction. In some embodiments, the first curve is laterally offset from the first axis in a right direction or a left direction, and the second curve is laterally offset from the second axis in the same direction. In some embodiments, the first curve is laterally offset from the first axis in a right direction and the second curve is laterally offset from the second axis in a left direction. In some embodiments, the first curve is laterally offset from the first axis in a left direction and the second curve is laterally offset from the second axis in a right direction. In some embodiments, the first curve is laterally offset from the first axis in a right direction and the second curve is laterally offset from the second axis in a right direction. In some embodiments, the first curve is laterally offset from the first axis in a left direction and the second curve is laterally offset from the second axis in a left direction.

In some embodiments, the angle formed by the first curve (e.g., between the first axis and the second axis) is at least about 25°, e.g., at least about 35°, about 45°, about 55°, about 65°, about 75°, about 85°, about 95°, about 105°, about 115°, about 125°, about 135°, about 145°, about 155°, about 165°, about 175°, about 185°, about 195°, about 205°, about 225°, about 235°, about 245°, about 255°, or more. In some embodiments, the angle formed by the first curve (e.g., between the first axis and the second axis) is between about 90° and 180°, e.g., about 95°, about 100°, about 105°, about 110°, about 115°, about 120°, about 125°, about 130°, about 135°, about 140°, about 145°, about 150°, about 155°, about 160°, about 155°, about 170°, or about 175°. In some embodiments, the angle formed by the second curve (e.g., between the second axis and the third axis) is at least about 25°, e.g., at least about 35°, about 45°, about 55°, about 65°, about 75°, about 85°, about 95°, about 105°, about 115°, about 125°, about 135°, about 145°, about 155°, about 165°, about 175°, about 185°, about 195°, about 205°, about 225°, about 235°, about 245°, about 255°, or more. In some embodiments, the angle formed by the second curve (e.g., between the second axis and the third axis) is between about 90° and 180°, e.g., about 90° and 180°, e.g., about 95°, about 100°, about 105°, about 110°, about 115°, about 120°, about 125°, about 130°, about 135°, about 140°, about 145°, about 150°, about 155°, about 160°, about 155°, about 170°, or about 175°. In some embodiments, the angle formed by the first curve (e.g., between the first axis and the second axis) is an obtuse angle. In some embodiments, the angle formed by the second curve (e.g., between the second axis and the third axis) is an obtuse angle.

The curved shape of the paintbrush (e.g., ergonomic paintbrush) handle may comprise an S shape. In some embodiments, the paintbrush (e.g., ergonomic paintbrush) handle comprises a sigmoidal curve shape. Preferably, the handle comprises a sigmoidal curve shape. In some embodiments, the S shape is defined by the arrangement of the first, second, and third axes. In some embodiments, the first curve between the top segment 6 and the middle segment 7, and the second curve between the middle segment 7 and the bottom segment 8, defines an S shape. In some embodiments, the second curve is oriented in the opposite direction relative to the first curve. In some embodiments, the second curve is oriented in the same direction relative to the first curve. Similarly, the sigmoidal curve shape can be defined by the arrangement of the first, second, and third axes. In some embodiments, the first curve between the top segment 6 and the middle segment 7, and the second curve between the middle segment 7 and the bottom segment 8, defines a sigmoidal curve shape. In some embodiments, the second curve is oriented in the opposite direction relative to the first curve. In some embodiments, the second curve is oriented in the same direction relative to the first curve.

In some embodiments, the S-shaped handle or sigmoidal curve-shaped handle provides a comfortable grip for the user, e.g., the S shape or sigmoidal curve shape provides a comfortable fit between a user's thumb and fingers. In some embodiments, the S-shaped handle or sigmoidal curve-shaped handle alleviates the pressure from the thumb typically associated with the use of conventional (e.g., straight) paintbrushes.

In some embodiments, the paintbrush (e.g., ergonomic paintbrush) comprises a brush head and a handle connected to the brush head. The handle may comprise a linear portion and a sigmoidal portion or a S-shaped portion. In some embodiments, the handle includes a linear portion proximate to the brush head, and a sigmoidal portion or an S-shaped portion. In some embodiments, the sigmoidal portion or S-shaped portion is distal to the brush head. In some embodiments, the linear portion comprises a neck segment 5 and/or a top segment 6. In some embodiments, the linear portion is tapered. In some embodiments, the linear portion has smoothed edges.

In some embodiments, the sigmoidal portion or S-shaped portion comprises one or more curves. For example, the sigmoidal portion or S-shaped portion can comprise two curves, e.g., a first curve and a second curve. In some embodiments, the sigmoidal portion or S-shaped portion comprises a first curve and a second curve. The first curve and second curve may be oriented in the same direction, or in opposite directions. In some embodiments, the first curve is laterally offset in a left direction. In some embodiments, the first curve is laterally offset in a right direction. In some embodiments, the second curve is laterally offset in a left direction. In some embodiments, the second curve is laterally offset in a right direction. In some embodiments, the first curve is laterally offset in a left direction and the second curve is laterally offset in a right direction. In some embodiments, the first curve is laterally offset in a right direction and the second curve is laterally offset in a left direction. In some embodiments, the first curve is laterally offset in a right direction and the second curve is laterally offset in a right direction. In some embodiments, the first curve is laterally offset in a left direction and the second curve is laterally offset in a left direction.

In some embodiments, the one or more curves (e.g., the first curve and second curve) are shaped to fit between a thumb and a finger of a person holding the handle. In some embodiments, the sigmoidal portion or S-shaped portion is tapered. In some embodiments, the sigmoidal portion has smoothed edges. In some embodiments, the sigmoidal portion comprises a middle segment 7 and/or a bottom segment 8. In some embodiments, the handle comprises a through hole 9, e.g., at the end of the handle distal to the brush head. In some embodiments, the sigmoidal portion is configured to reduce fatigue while holding the handle (e.g., while using the paintbrush). In some embodiments, the sigmoidal portion is configured to reduce or prevent pain (e.g., pain associated with repetitive strain injury), e.g., from using the paintbrush. In some embodiments, the sigmoidal portion or S-shaped portion is configured to improve efficiency of painting when using the paintbrush.

The components of the paintbrush (e.g., ergonomic paintbrush) disclosed herein, e.g., the handle and brush, can be substantially coplanar. In other words, the ergonomic paintbrush can have a flat profile, as viewed from the side. In some embodiments, the different components of the paintbrush are not coplanar, e.g., a paintbrush with a non-planar profile, as viewed from the side. For example, a paintbrush with a substantially co-planar brush head and neck segment may have a handle that is angled into or out of the plane defined by the brush head and neck segment. In some embodiments, the paintbrush has a curved, rounded, or bent profile, as viewed from the side.

In some embodiments, a cross section may be taken along a segment of the handle, e.g., a cross section at the midpoint of the top segment. In some embodiments, the handle of the paintbrush (e.g., ergonomic paintbrush) features a rectangular cross section, as viewed at the neck segment, top segment, middle segment, or bottom segment. The edges of the paintbrush handle may be smooth (e.g., rounded), for increased comfort and ease of use. In some embodiments, the handle of the paintbrush features a substantially elliptical cross section. In some embodiments, the handle of the paintbrush features a substantially rectangular cross section, e.g., a rectangle with smoothed corners.

In some embodiments, the entire length of the handle is tapered. In some embodiments, segments of the handle are wider than other segments. For example, the neck segment 5 may be wider than the top segment 6. In some embodiments, the handle is tapered from the neck segment 5 to the top segment 6. In some embodiments, the handle is tapered from the neck segment 5 to the middle segment 7. In some embodiments, the handle is tapered from the neck segment 5 to the bottom segment 8.

The width of the handle of a paintbrush described herein may vary, depending on where the measurement is taken. For example, a measurement taken at the midpoint of the top segment 6 may be greater than another measurement taken at the midpoint of the middle segment 7 or bottom segment 8.

In some embodiments, the width at about the midpoint of the top segment 6 is between about 2.5 cm and about 4.5 cm, e.g., about 2.6 cm, about 2.8 cm, about 3.0 cm, about 3.2 cm, about 3.4 cm, about 3.6 cm, about 3.8 cm, about 4.0 cm, about 4.2 cm, or about 4.4 cm, or more (or between about 1 inch and about 3 inches, e.g., about 1.0 inch, 1.1 inches, 1.2 inches, 1.3 inches, 1.4 inches, 1.5 inches, 1.6 inches, 1.7 inches, or about 1.8 inches, or more). In some embodiments, the width at the midpoint of the top segment is about 3.2 cm (or about 1.25 inches, e.g., as shown in FIG. 1). In some embodiments, the width at the midpoint of the top segment is 3.18 cm (1.25 inches).

In some embodiments, the width at about the midpoint of the middle segment 7 is between about 1.9 cm and about 3.2 cm, e.g., about 2.0 cm, about 2.2 cm, about 2.4 cm, about 2.6 cm, about 2.8 cm, or about 3.0 cm, or more (or between about 0.5 inches and about 1.5 inches, e.g., about 0.6 inches, 0.7 inches, 0.8 inches, 0.9 inches, 1.0 inch, 1.1 inches, 1.2 inches, 1.3 inches, 1.4 inches, or about 1.5 inches, or more). In some embodiments, the width at the midpoint of the middle segment is about 2.2 cm (or about ⅞ inches, e.g., as shown in FIG. 1). In some embodiments, the width at the midpoint of the middle segment is 2.24 cm (0.88 inches).

In some embodiments, the width at about the midpoint of the bottom segment 8 is between about 0.8 cm and about 2.2 cm, e.g., about 0.8 cm, about 1.0 cm, about 1.2 cm, about 1.4 cm, about 1.8 cm, about 1.9 cm, about 2.0 cm, or about 2.2 cm, or more (or between about 0.2 inches and 1.0 inch, e.g., about 0.2 inches, 0.3 inches, 0.4 inches, 0.5 inches, 0.6 inches, 0.7 inches, 0.8 inches, 0.9 inches, or 1.0 inch, or more). In some embodiments, the width at the midpoint of the bottom segment is about 1.9 cm (or about 0.75 inches, e.g., as shown in FIG. 1). In some embodiments, the width at the midpoint of the bottom segment is 1.91 cm (0.75 inches).

In some embodiments, the handle is wider at about the midpoint of the top segment 6 relative to at about the midpoint of the middle segment 7. In some embodiments, the handle is wider at about the midpoint of the middle segment 7 relative to at about the midpoint of the bottom segment 8.

In some embodiments, the width at the midpoint of the top segment 6 is at least 1.1-fold greater than the width at the midpoint of the middle segment 7, e.g., about 1.2-fold, about 1.3-fold, about 1.4-fold, about 1.5-fold, about 1.6-fold, about 1.7-fold, about 1.8-fold, about 1.9-fold, about 2.0-fold, or more, greater than the width at the midpoint of the middle segment. In some embodiments, the width at the midpoint of the top segment is about 1.5-fold greater than the width at the midpoint of the middle segment. In some embodiments, the width at the midpoint of the top segment is at least 10% greater than the width at the midpoint of the middle segment, e.g., about 15%, 20%, 25%, 30%, 35%, 40%, 45%, 50%, 55%, 60%, 65%, 70%, 75%, 80%, 85%, 90%, 95%, 100%, 110%, 120%, 130%, 140%, 150%, 200%, or more, greater than the width at the midpoint of the middle segment.

In some embodiments, the width of the handle at the midpoint of the middle segment 7 is at least at least 1.1-fold greater than the width at the midpoint of the bottom segment 8, e.g., about 1.2-fold, about 1.3-fold, about 1.4-fold, about 1.5-fold, about 1.6-fold, about 1.7-fold, about 1.8-fold, about 1.9-fold, about 2.0-fold, or more, greater than the width at the midpoint of the bottom segment. In some embodiments, the width of the handle at the midpoint of the middle segment is about 1.2-fold greater than the width of the handle at the midpoint of the bottom segment. In some embodiments, the width at the midpoint of the middle segment is at least 10% greater than the width at the midpoint of the bottom segment, e.g., about 15%, 20%, 25%, 30%, 35%, 40%, 45%, 50%, 55%, 60%, 65%, 70%, 75%, 80%, 85%, 90%, 95%, 100%, 110%, 120%, 130%, 140%, 150%, 200%, or more, greater than the width at the midpoint of the bottom segment.

The different segments of the paintbrush (e.g., ergonomic paintbrush) handle may also be different lengths relative to one another. For example, the top segment 6 may be elongated or truncated, e.g., depending on the desired application of the paintbrush. In some embodiments, the top segment is longer than the middle segment 7. In some embodiments, the top segment is longer than the bottom segment 8. In some embodiments, the top segment is shorter than the bottom segment. In some embodiments, the middle segment is shorter than the top segment, the bottom segment, or both.

In some embodiments, the top segment 6 is between about 4 cm to about 40 cm long, e.g., about 5 cm, 6 cm, 7 cm, 8 cm, 9 cm, 10 cm, 11 cm, 12 cm, 13 cm, 14 cm, 15 cm, 16 cm, 17 cm, 18 cm, 19 cm, 20 cm, 21 cm, 22 cm, 23 cm, 24 cm, 25 cm, 26 cm, 27 cm, 28 cm, 29 cm, 30 cm, 31 cm, 32 cm, 33 cm, 34 cm, 35 cm, 36 cm, 37 cm, 38 cm, 39 cm, or about 40 cm, or more, in length (or between about 1.5 inches to about 15 inches in length, e.g., between about 1.5 inches to about 14 inches in length, e.g., between about 1.4 to about 4 inches in length, e.g., about 1.5 inches, 2.0 inches, 2.5 inches, 3.0 inches, 3.5 inches, 4.0 inches, 4.5 inches, 5.0 inches, 5.5 inches, 6.0 inches, 6.5 inches, 7.0 inches, 7.5 inches, 8.0 inches, 8.5 inches, 9.0 inches, 9.5 inches, 10.0 inches, 10.5 inches, 11.0 inches, 11.5 inches, 12.0 inches, 12.5 inches, 13.0 inches, 13.5 inches, 14.0 inches, 14.5 inches, 15.0 inches, or more). In some embodiments, the top segment is between about 6.0 cm and about 7.0 cm in length, e.g., about 6.1 cm, about 6.2 cm, about 6.3 cm, about 6.4 cm, about 6.5 cm, about 6.6 cm, about 6.7 cm, about 6.8 cm, or about 6.9 cm in length (or about 2.5 inches, about 2.6 inches, about 2.7 inches, or about 2.8 inches). In some embodiments, the top segment is about 6.4 cm (or about 2.5 inches) in length. In some embodiments, the top segment is between about 18.5 cm and about 19.5 cm in length, e.g., about 18.6 cm, 18.7 cm, 18.8 cm, 18.9 cm, 19.0 cm, 19.1 cm, 19.2 cm, 19.3 cm, or 19.4 cm in length (or about 7.3 inches, about 7.4 inches, about 7.5 inches, about 7.6 inches, or about 7.7 inches). In some embodiments, the top segment is about 19.0 cm (or about 7.5 inches) in length. In some embodiments, the top segment is between about 33.7 cm and about 34.7 cm in length, e.g., about 33.8 cm, 33.9 cm, 34.0 cm, 34.1 cm, 34.2 cm, 34.3 cm, 34.4 cm, 34.5 cm, or 34.6 cm in length (or about 13.3 inches, about 13.4 inches, about 13.5 inches, about 13.6 inches, or about 13.7 inches). In some embodiments, the top segment is about 34.2 cm (or about 13.5 inches) in length.

In some embodiments, the middle segment 7 is between about 2 cm to about 10 cm long, e.g., about 3 cm, 4 cm, 5 cm, 6 cm, 7 cm, 8 cm, or 9 cm, or more, in length (or about 1.5 inches to about 8 inches, e.g., about 1.5 inches to about 4.0 inches, e.g., about 1.5 inches, about 2.0 inches, about 2.5 inches, about 3.0 inches, about 3.5 inches, about 4.0 inches, about 4.5 inches, about 5.0 inches, about 5.5 inches, about 6.0 inches, about 6.5 inches, about 7.0 inches, about 7.5 inches, or about 8.0 inches). In some embodiments, the middle segment is between about 4.5 cm to about 5.5 cm in length, e.g., about 4.6 cm, 4.7 cm, 4.8 cm, 4.9 cm, 5.0 cm, 5.1 cm, 5.2 cm, 5.3 cm, or 5.4 cm in length (or about 1.8 inches, about 1.9 inches, about 2.0 inches, or about 2.1 inches). In some embodiments, the middle segment is about 5.1 cm (or about 2 inches) in length. In some embodiments, the bottom segment 8 is between about 7 cm to about 14 cm long, e.g., about 8 cm, 9 cm, 10 cm, 11 cm, 12 cm, or 13 cm, or more, in length (or between about 2 inches to about 13.5 inches, e.g., between about 2 inches to about 3.5 inches, e.g., about 2.0 inches, about 2.5 inches, about 3.0 inches, or about 3.5 inches, about 4.0 inches, or more). In some embodiments, the bottom segment is between about 8.5 and 9.3 cm in length, e.g., about 8.6 cm, 8.7 cm, 8.8 cm, 8.9 cm, 9.0 cm, or 9.1 cm in length (or about 3.3 inches, about 3.4 inches, about 3.5 inches, about 3.6 inches, or about 3.7 inches). In some embodiments, the bottom segment is about 8.9 cm (or about 3.5 inches) in length.

The neck segment 5 of the paintbrush (e.g., ergonomic paintbrush) described herein may be any suitable width or length, e.g., to accommodate the brush head. For example, at its widest point (e.g., where the neck segment 5 is in contact with the brush head 4), the neck segment may be between about 0.05 cm and about 20 cm wide, e.g., about 0.10 cm, 0.15 cm, 0.20 cm, 0.25 cm, 0.30 cm, 0.35 cm, 0.40 cm, 0.45 cm, 0.50 cm, 0.75 cm, 1.0 cm, 1.1 cm, 1.2 cm, 1.4 cm, 1.6 cm, 1.8 cm, 2.0 cm, 2.5 cm, 3.0 cm, 3.5 cm, 4.0 cm, 4.5 cm, 5.0 cm, 5.5 cm, 6.0 cm, 6.5 cm, 7.0 cm, 7.5 cm, 8.0 cm, 8.5 cm, 9.0 cm, 10 cm, 11 cm, 12 cm, 13 cm, 14 cm, 15 cm, 16 cm, 17 cm, 18 cm, 19 cm, or 20 cm, or more, wide (or between about 0.02 inches and about 8 inches, e.g., about 0.05 inches, 0.1 inch, 0.2 inches, 0.4 inches, 0.6 inches, 0.8 inches, 1.0 inches, 1.2 inches, 1.4 inches, 1.6 inches, 1.8 inches, 2.0 inches, 2.5 inches, 3.0 inches, 3.5 inches, 4.0 inches, 4.5 inches, 5.0 inches, 5.5 inches, 6.0 inches, 6.5 inches, 7.0 inches, 7.5 inches, or 8.0 inches, or more). In some embodiments, at its widest point (e.g., where the neck is in contact with the brush head), the neck segment is about 0.3 cm (or about 0.5 inches), 2.5 cm (or about 1 inch), 3.8 cm (or about 1.5 inches), 6.3 cm (or about 2.5 inches), 7.6 cm (or about 3 inches), 8.9 cm (or about 3.5 inches), 10.2 cm (or about 4 inches), or 11 cm (about 4.5 inches) wide.

In some embodiments, the neck segment 5 is between about 3 cm and about 12 cm long, e.g., about 4, 5, 6, 7, 8, 9, 10, or 11 cm, or more, long (or between about 1.1 inches and about 4.8 inches, e.g., about 1.2 inches, 1.4 inches, 1.6 inches, 1.8 inches, 2.0 inches, 2.5 inches, 3.0 inches, 3.5 inches, 4.0 inches, 4.5 inches, 5.0 inches, or more). In some embodiments, the neck segment is between about 5.8 cm and 6.8 cm long, e.g., about 5.9 cm, 6.0 cm, 6.1 cm, 6.2 cm, 6.3 cm, 6.4 cm, 6.5 cm, 6.6 cm, or 6.7 cm long (or between about 2.2 inches and about 2.7 inches, e.g., about 2.2 inches, about 2.3 inches, about 2.4 inches, about 2.5 inches, about 2.6 inches, or about 2.7 inches). In some embodiments, the neck segment is 6.4 cm (2.5 inches) long.

Figure 2:
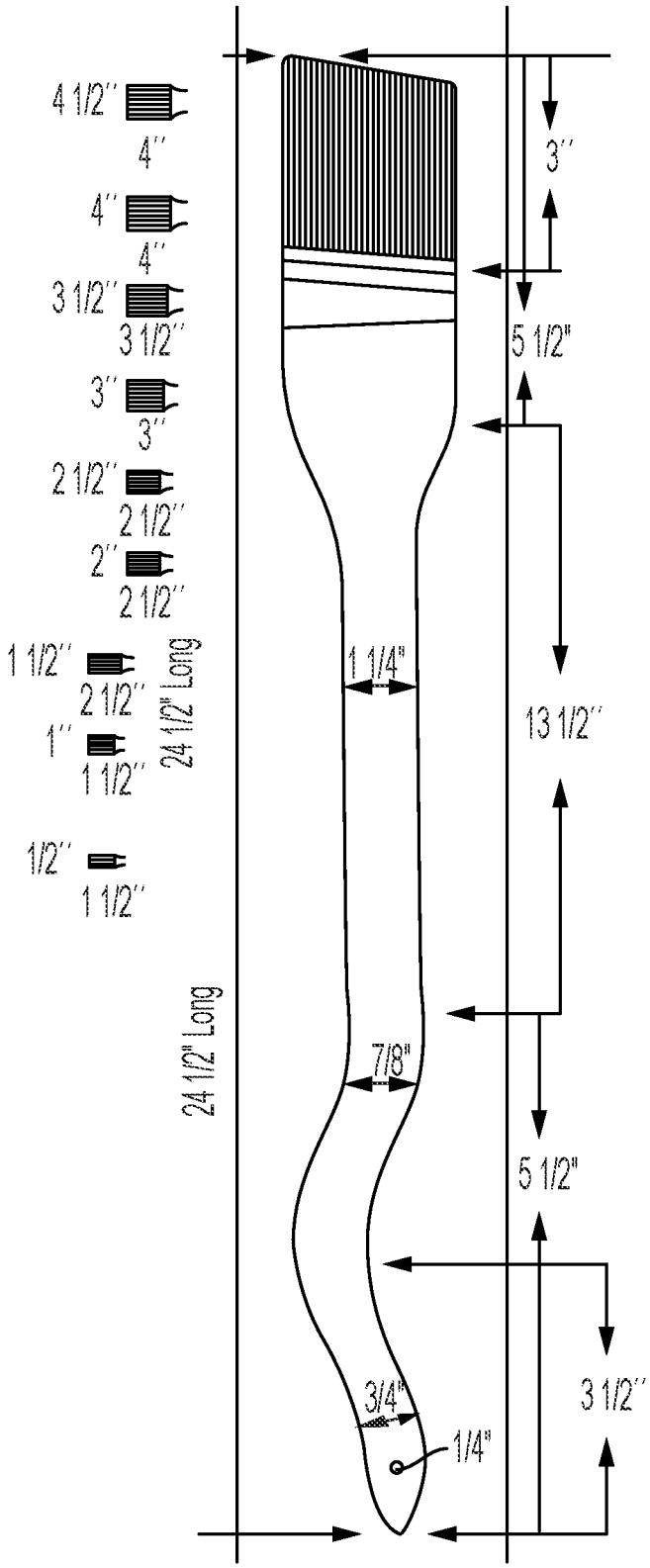
FIG. 2 provides a front perspective view of an exemplary ergonomic paintbrush, and exemplary brush head designs.
Figure 3:
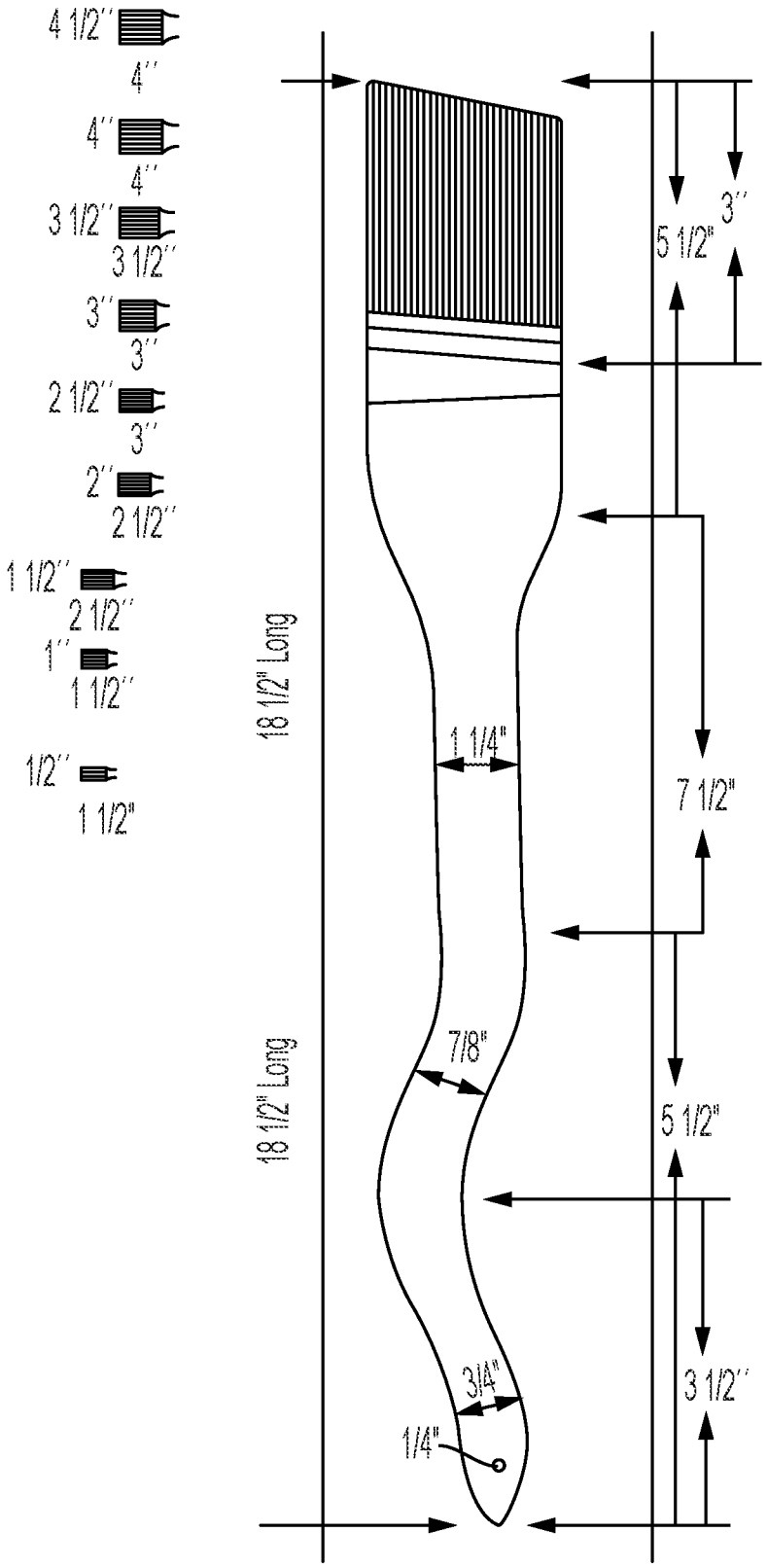
FIG. 3 provides a front perspective view of an exemplary ergonomic paintbrush, and exemplary brush head designs.
Figure 4:
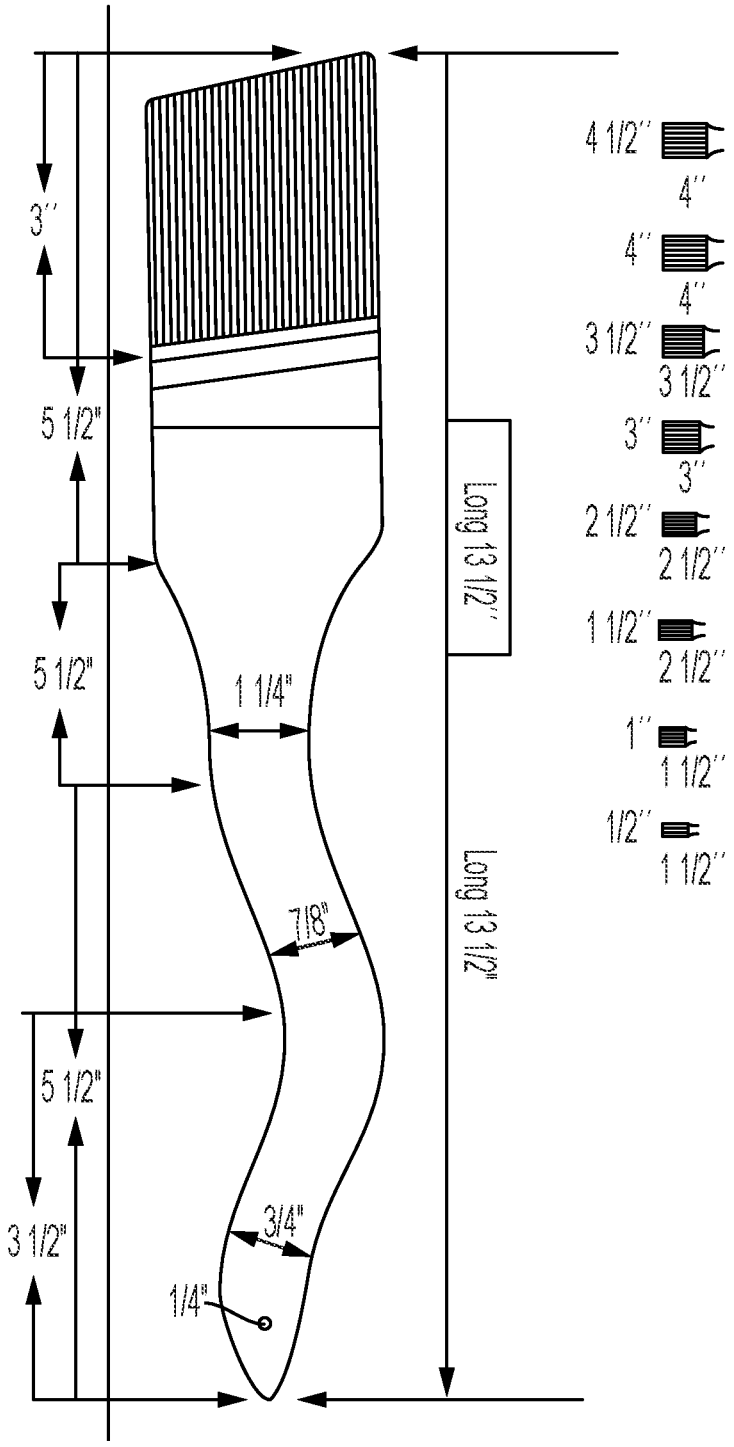
FIG. 4 provides a front perspective view of exemplary ergonomic paintbrush, and exemplary brush head designs.
Figure 5:
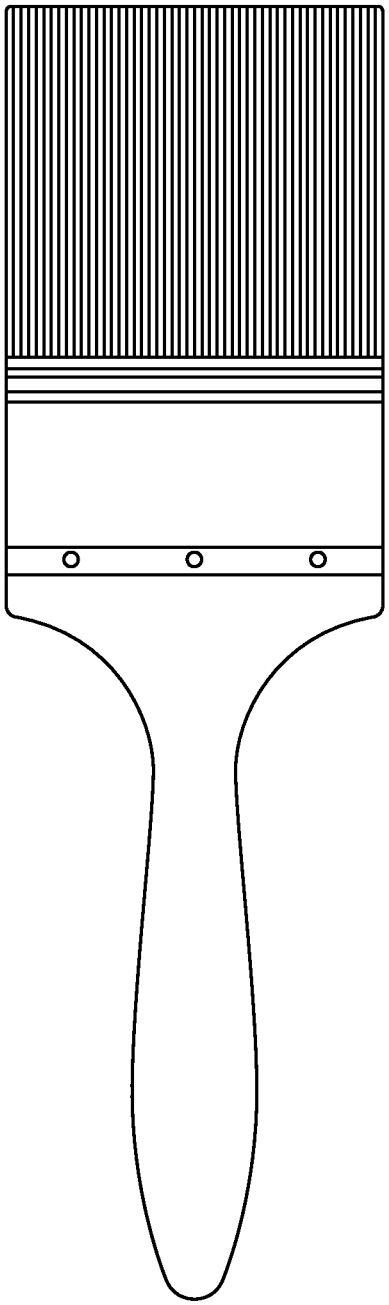
FIG. 5 provides a front perspective view of a conventional paintbrush.

The length of the entire paintbrush can vary, e.g., based on the desired application of the paintbrush. In some embodiments, the length of the entire paintbrush (e.g., as measured from the toe 1 of the bristles to the very base of the bottom segment 8 of the handle) is between about 15 cm to about 80 cm, e.g., between about 20 cm and about 75 cm, between about 30 cm and about 40 cm, between about 40 cm and about 50 cm, between about 50 cm and about 60 cm, or between about 60 cm and about 70 cm (or between about 5 inches to about 32 inches, e.g., about 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, or 32 inches). In some embodiments, the length of the entire paintbrush is about 10 cm, about 15 cm, about 20 cm, about 25 cm, about 30 cm, about 35 cm, about 40 cm, about 45 cm, about 50 cm, about 55 cm, about 60 cm, about 65 cm, about 70 cm, or longer. In some embodiments, the paintbrush is about 62 cm (or about 24.5 inches), e.g., as shown in FIG. 2. In some embodiments, the paintbrush is about 47 cm (or about 18.5 inches), e.g., as shown in FIG. 3. In some embodiments, the paintbrush is about 34 cm (or about 13.5 inches), e.g., as shown in FIG. 4.

The measurements of each length described herein may be determined by measuring along the axis (e.g., the first axis) of the paintbrush handle (see, e.g., FIGS. 1-4). The measurements of each width described herein may be determined by measuring perpendicular to the axis (e.g., the first axis) of the paintbrush handle, or directly from the left to right hand side of a segment of the paintbrush (see, e.g., FIGS. 1-4).

Without wishing to be bound by theory, the particular dimensions and curvature (e.g., the presence of an S shape) in the handle of the paintbrush described herein can achieve beneficial properties, including but not limited to, increasing the comfort of using the paintbrush, relieving pain from using the paintbrush (e.g., pain associated with repetitive strain injury or carpal tunnel syndrome), preventing or relieving carpal tunnel syndrome, preventing or relieving repetitive strain injury, and providing balance to the paintbrush, and improving efficiency of using the paintbrush, relative to a conventional paintbrush (e.g., a paintbrush with a straight handle).

The brush head 4 of a paintbrush described herein (e.g., an ergonomic paintbrush) may be any size or dimension, e.g., as suited to a particular application. In some embodiments, the brush head comprises bristles 2 that protrude from the end of the brush head, e.g., protruding outwardly from the opposite end of the brush head relative to the neck segment 5. The shape formed by the bristles can vary, e.g., depending on the desired application of the brush. In some embodiments, the bristles form a rectangular shape, a pointed shape, a triangular shape, a chisel shape, a flat shape, a filbert shape, a fan shape, an angled shape, a mop shape, a rigger shape, or a round shape (e.g., sash brush).

The brush head 4 may be a similar width to the neck segment 5 (e.g., substantially the same width as the neck segment). In some embodiments, the brush head 4 is between about 0.05 cm and about 20 cm, e.g., about 0.10 cm, 0.15 cm, 0.20 cm, 0.25 cm, 0.30 cm, 0.35 cm, 0.40 cm, 0.45 cm, 0.50 cm, 0.75 cm, 1.0 cm, 1.1 cm, 1.2 cm, 1.4 cm, 1.6 cm, 1.8 cm, 2.0 cm, 2.5 cm, 3.0 cm, 3.5 cm, 4.0 cm, 4.5 cm, 5.0 cm, 5.5 cm, 6.0 cm, 6.5 cm, 7.0 cm, 7.5 cm, 8.0 cm, 8.5 cm, 9.0 cm, 10 cm, 11 cm, 12 cm, 13 cm, 14 cm, 15 cm, 16 cm, 17 cm, 18 cm, 19 cm, or 20 cm or more, wide, e.g., as measured at the heel 3 of the bristles. In some embodiments, the brush head 4 is about 0.3 cm (or about 0.5 inches), 2.5 cm (or about 1 inch), 3.8 cm (or about 1.5 inches), 6.3 cm (or about 2.5 inches), 7.6 cm (or about 3 inches), 8.9 cm (or about 3.5 inches), 10.2 cm (or about 4 inches), or 11 cm (about 4.5 inches) wide, e.g., as measured from the heel 3 of the bristles (see, e.g., FIGS. 2-4).

The length of the bristles 2 of a paintbrush described herein (e.g., an ergonomic paintbrush) may be any suitable length, e.g., as suited for a particular application. In some embodiments, the paintbrush comprises brushes of unequal length. For example, a brush head may feature bristles of an unequal length to achieve an angled toe 1 (e.g., as shown in FIGS. 1-4). On the other hand, a brush head may feature bristles that are substantially the same length to achieve a straight toe (e.g., the tip of the paintbrush is flush with a surface when the brush is held directly perpendicular to said surface). Other angles or shapes may be achieved through a combination of bristles of unequal lengths, e.g., chisel-shaped toes or rounded toes. In some embodiments, the brush head 4 comprises bristles 2 of an unequal length to provide an angled toe (see, e.g., FIGS. 1-4).

In some embodiments, the paintbrush (e.g., ergonomic paintbrush) comprises bristles 2 with a length of about between 0.05 cm and about 20 cm, e.g., about 0.10 cm, 0.15 cm, 0.20 cm, 0.25 cm, 0.30 cm, 0.35 cm, 0.40 cm, 0.45 cm, 0.50 cm, 0.75 cm, 1.0 cm, 1.1 cm, 1.2 cm, 1.4 cm, 1.6 cm, 1.8 cm, 2.0 cm, 2.5 cm, 3.0 cm, 3.5 cm, 4.0 cm, 4.5 cm, 5.0 cm, 5.5 cm, 6.0 cm, 6.5 cm, 7.0 cm, 7.5 cm, 8.0 cm, 8.5 cm, 9.0 cm, 10 cm, 11 cm, 12 cm, 13 cm, 14 cm, 15 cm, 16 cm, 17 cm, 18 cm, 19 cm, or 20 cm, or more, e.g., as measured from the heel 3 of the bristles to the toe 1. In some embodiments, the paintbrush comprises bristles that are about 3.8 cm (or about 1.5 inches), 6.3 cm (or about 2.5 inches), 7.6 cm (or about 3 inches), 8.9 cm (or about 3.5 inches), 10.2 cm (or about 4 inches), or 11 cm (about 4.5 inches) long, e.g., as measured from the heel of the bristles to the toe (see, e.g., FIGS. 2-4).

In some embodiments, the bristles 2 are substantially coplanar with the brush head 4 and neck segment 5, e.g., the bristles project directly outwards from the brush head along an axis aligned with the brush head and neck segment (e.g., the first axis).

The paintbrushes of the present disclosure (e.g., ergonomic paintbrushes) can comprise bristles 2 of any suitable material. For example, the bristles may be natural or synthetic fibers. In some embodiments, the bristles comprise nylon, polyester, polypropylene, or a combination thereof. In some embodiments, the paintbrush comprises nylon fibers. In some embodiments, the paintbrush comprises polyester fibers. In some embodiments, the paintbrush comprises fibers comprising a combination of nylon and polyester. In some embodiments, the bristles comprise natural fibers such as animal hair. In some embodiments, the bristles comprise hog hair (e.g., hog bristle), badger hair, squirrel hair, sable, ox hair, pony hair, horse hair, goat hair, mongoose hair, or the like).

The bristles 2 may comprise flagged ends, split ends, or tipped ends e.g., to hold more paint, spread paint more smoothly, or spread paint more precisely, relative to a paintbrush without flagged, split, or tipped ends.

In some embodiments, the brush head 4 comprises a ferrule. The ferrule can serve several functions in the paintbrush, e.g., fasten the bristles 2 to the brush head 4, hold the shape of the bristles, and protect the handle of the paintbrush. In some embodiments, the ferrule is constructed substantially of metal, such as steel (e.g., stainless steel, nickel-plated steel, copper-plated steel, tin-plated steel, brass-plated steel, and the like). The ferrule can be fastened to the handle of the paintbrush (e.g., at the neck segment 5) by any conventional means, such as by a crimp, glue, or one or more rivets, or a combination thereof.

The paintbrushes (e.g., ergonomic paintbrushes) of the present disclosure can possess other features, e.g., to improve their use, cleaning, or storage. For example, the paintbrush can comprise a through hole 9 (or a lanyard hole) to permit hanging the paintbrush (e.g., from a hook or string). In some embodiments, the paintbrush comprises a through hole 9 in the lower end of the bottom segment 8, e.g., to permit hanging the paintbrush upside down. The paintbrush may comprise more than one through hole. Additionally, the paintbrush may comprise other design features, e.g., smoothed edges or notches in the handle. The through hole may have any suitable diameter, e.g., for hanging the paintbrush. In some embodiments, the through hole has a diameter of between about 0.1 cm to about 2 cm, e.g., between about 0.25 cm to about 1 cm, or between about 0.5 cm to about 0.75 cm, e.g., about 0.1 cm, 0.2 cm, 0.3 cm, 0.4 cm, 0.5 cm, 0.6 cm, 0.7 cm, 0.8 cm, 0.9 cm, or 1.0 cm. In some embodiments, the through hole has a diameter of about 0.64 cm (or about 0.25 inches).

The handle of the paintbrushes described herein can be constructed of any suitable material. In some embodiments, the handle is constructed of wood, plastic, metal, or a combination thereof. In some embodiments, the handle is substantially wood. The wood may be any suitable type of wood, e.g., a hardwood, such as beech, maple, or poplar. The wood may be unfinished, varnished, or painted. In paintbrushes comprising plastic, the plastic can be any suitable plastic, such as acrylic.

The brush head 4 may comprise a similar material to the handle, or may be constructed of a different material. In some embodiments, the brush head comprises a metal (e.g., a brush head comprising a metal ferrule). In some embodiments, the brush head comprises a combination of wood and metal. In some embodiments, the metal is steel, e.g., stainless steel, nickel-plated steel, copper-plated steel, tin-plated steel, brass-plated steel, and the like.

The paintbrushes of the present disclosure are designed for increased comfort, e.g., for long periods of painting. Without wishing to be bound by theory, the curvature of the handle (e.g., the S-shape, e.g., as shown in FIGS. 1-4) provides a comfortable grip for the user. In some embodiments, the paintbrush is configured to be held by a user at about the middle segment 7 and bottom segment 8 of the handle, e.g., at the S-shaped region of the handle. In some embodiments, the handle is configured to reduce fatigue when using the paintbrush, relative to the use of a paintbrush without a curved or S-shaped handle (e.g., a paintbrush with a straight handle). In some embodiments, the paintbrush comprises a handle configured to reduce or prevent pain associated with carpal tunnel syndrome, e.g., relative to the use of a paintbrush without a curved or S-shaped handle (e.g., a paintbrush with a straight handle). In some embodiments, the handle is configured to improve efficiency of painting when using the paintbrush, relative to the use of a paintbrush without an S-shaped handle.

Without wishing to be bound by theory, it is believed that the S-shaped handle of the paintbrushes described herein provides superior comfort, efficiency of use, and greater alleviation of pain (e.g., alleviation of pain associated with carpal tunnel syndrome or repetitive strain injury), relative to paintbrushes with handles comprising other handles, e.g., handles having only one lateral curve, e.g., crescent-shaped handles as described in U.S. Publication No.: US 2004/0231083. Additionally, the S-shaped handle can provide a place for the user to grip the brush without holding the brush head (e.g., the paintbrush can be gripped towards the bottom segment of the brush), which can provide better balance, less discomfort to the user, and improved efficiency for painting.

The paintbrushes of the present disclosure are suitable for use with any format, including paint, varnish, stain, and the like. In some embodiments, the paintbrush can be used for applying semi-gloss, gloss, enamel, oil-based paint, water-based paint, eggshell paint, matte paint, and flat sheen paint, to any suitable surface (e.g., a wall). The paintbrushes can be used in any suitable application, or on any surface, including painting the interior or exterior of buildings. The paintbrushes described herein are convenient to clean, e.g., using conventional paintbrush cleaning methods. The ergonomic design of the paintbrushes described herein can allow the painter to be flexible.

EQUIVALENTS

It will be readily apparent to those skilled in the art that other suitable modifications, alternative constructions, and adaptions to the invention described herein are obvious and may be made using suitable equivalents without departing from the scope of the disclosure or the embodiments.

What is claimed:

1. An ergonomic paintbrush comprising: a handle comprising a neck segment, a top segment, a middle segment, and a bottom segment; and a brush head connected to the neck segment of the handle; wherein:

(i) the top segment of the handle is aligned with the neck segment and the brush head;

(ii) the middle segment is laterally offset from the top segment by a first curve; and (iii) the bottom segment is laterally offset from the middle segment by a second curve; wherein the combination of the first curve and second curve forms a sigmoidal curve in the handle configured to fit between a user's thumb and fingers, wherein said sigmoidal curve is distal to the brush head, wherein said brush head is substantially co-planar with said top segment, said middle segment, and said bottom segment of the handle.

2. The ergonomic paintbrush of claim 1, wherein the second curve is oriented in the opposite direction relative to the first curve.

3. The ergonomic paintbrush of claim 1, wherein:

(i) the middle segment is laterally offset from the top segment in a left direction; or (ii) the middle segment is laterally offset from the top segment in a right direction.

4. The ergonomic paintbrush of claim 1, wherein:

(i) the bottom segment is laterally offset from the top segment in a left direction; or (ii) the bottom segment is laterally offset from the middle segment in a right direction.

5. The ergonomic paintbrush of claim 1, wherein the midpoint of the top segment comprises a cross section, and the shape of the cross section is substantially rectangular.

6. The ergonomic paintbrush of claim 1, wherein the handle is tapered from the neck segment to the top segment.

7. The ergonomic paintbrush of claim 1, wherein:

(i) the handle is wider at the midpoint of the top segment relative to the midpoint of the middle segment; and/or (ii) the handle is wider at the midpoint of the middle segment relative to the midpoint of the bottom segment.

8. The ergonomic paintbrush of claim 1, wherein the width of the handle at the midpoint of the top segment is about 1 inch to about 3 inches, and/or wherein the width of the handle at the midpoint of the middle segment is about 0.5 inches to about 1.5 inches.

9. The ergonomic paintbrush of claim 1, wherein:

(i) the top segment is about 1.5 inches to about 14 inches in length;

(ii) the middle segment is about 1.5 inches to about 2.5 inches in length; and/or (iii) the bottom segment is about 2.5 inches to about 4.5 inches in length.

10. The ergonomic paintbrush of claim 1, wherein:

(i) the length of the top segment is about 2 inches to about 3.5 inches;

(ii) the length of the top segment is about 2 inches to about 7.5 inches; or (iii) the length of the top segment is about 2 inches to about 13.5 inches.

11. The ergonomic paintbrush of claim 1, wherein the brush head comprises bristles that protrude from the opposite end of the brush head relative to the neck segment.

12. The ergonomic paintbrush of claim 11, wherein the bristles are substantially coplanar with the brush head and neck segment.

13. The ergonomic paintbrush of claim 11, wherein the bristles are of unequal length to provide an angled toe.

14. The ergonomic paintbrush of claim 11, wherein the bristles comprise natural or synthetic fibers.

15. The ergonomic paintbrush of claim 11, wherein the bristles comprise nylon, polyester, or a combination thereof.

16. The ergonomic paintbrush of claim 1, wherein the handle comprises wood, plastic, metal, or a combination thereof.

17. The ergonomic paintbrush of claim 1, wherein the paintbrush is configured to be held by a user at about the middle and bottom segments of the handle.

18. The ergonomic paintbrush of claim 1, wherein the handle is configured to:

(i) reduce fatigue when using the paintbrush; and/or (ii) reduce or prevent pain associated with repetitive strain injury when using the paintbrush; and/or improve efficiency of painting when using the paintbrush.

* * * * *